US005327049A

United States Patent [19]

Smolka et al.

[11] Patent Number: 5,327,049

[45] Date of Patent: Jul. 5, 1994

[54] ELECTRODELESS LOW-PRESSURE DISCHARGE LAMP WITH PLASMA CHANNEL

[75] Inventors: Ernst Smolka, Reutlingen; Werner Schwarz, Gelnhausen; Peter March, Frankfurt am Main; Klaus-Jürgen Dietz, Wiesbaden, all of Fed. Rep. of Germany

[73] Assignee: Heraeus Instruments GmbH, Hanau, Fed. Rep. of Germany

[21] Appl. No.: 999,561

[22] Filed: Dec. 30, 1992

Related U.S. Application Data

[63] Continuation of Ser. No. 877,410, May 1, 1992, abandoned.

[30] Foreign Application Priority Data

Jun. 24, 1991 [DE] Fed. Rep. of Germany ..... 4120730

[51] Int. Cl.[5] ..... H05B 41/24; H01J 11/02

[52] U.S. Cl. ..... 315/248; 315/326; 313/110; 313/161; 313/612

[58] Field of Search ..... 315/248, 326, 344; 313/110, 153, 161, 607, 608, 609, 610, 611, 612

[56] References Cited

U.S. PATENT DOCUMENTS

| | | | |
|---|---|---|---|
| 4,177,422 | 12/1979 | Deficis et al. | 315/248 X |
| 4,959,592 | 9/1990 | Anderson et al. | 315/248 |
| 5,117,150 | 5/1992 | Schwarz et al. | 313/112 |

FOREIGN PATENT DOCUMENTS

| | | |
|---|---|---|
| 0074690 | 3/1983 | European Pat. Off. . |
| 0316189 | 5/1989 | European Pat. Off. . |
| 633760 | 8/1936 | Fed. Rep. of Germany . |
| 911871 | 8/1953 | Fed. Rep. of Germany . |
| 911870 | 9/1953 | Fed. Rep. of Germany . |
| 3908553 | 4/1990 | Fed. Rep. of Germany . |
| 1485625 | 5/1967 | France . |
| 341469 | 1/1931 | United Kingdom . |
| 385835 | 1/1933 | United Kingdom . |
| 1003873 | 9/1965 | United Kingdom . |
| 1112215 | 5/1968 | United Kingdom . |
| 1555094 | 1/1979 | United Kingdom . |
| 2066630A | 7/1981 | United Kingdom . |

*Primary Examiner*—David Mis

*Attorney, Agent, or Firm*—Frishauf, Holtz, Goodman & Woodward

[57] ABSTRACT

An electrodeless low pressure discharge lamp, preferably filled with deuterium gas, is provided with a cylindrical envelope made from quartz glass and surrounded by a cylindrical excitation coil driven at between 10 and 800 MHz. Within the lamp envelope, there is provided a cylindrical aperture member made from boron nitride which in a radial direction extends to the inner surface of the envelope and which is provided with an uninterrupted coaxial channel for confining to a small diameter the plasma discharge arc generated during operation of the lamp, the aperture member having an optical axis extending through coaxially with its channel, the radiation emitting in a directed pattern along the optical axis.

13 Claims, 4 Drawing Sheets

ELECTRODELESS LOW-PRESSURE DISCHARGE LAMP WITH PLASMA CHANNEL

This application is a continuation of application Ser. No. 07/877,410, filed May 1, 1992, abandoned.

CROSS-REFERENCE TO RELATED PATENTS AND APPLICATIONS

European Patent 0 074 690, POSTMA/N. V. PHILIPS, publ. 23 MAR. '83; German Patent Disclosure DE-OS 39 18 839=U.S. Pat. No. 4,959,592; German Patent Disclosure DE-OS 39 08 553, THOMAS, MARCH & SCHWARZ. German Patent Disclosure DE-OS 39 02 144=U.S. Ser. No. 07/572,962, now U.S. Pat. No. 5,117,150 corresponding to PCT/EP 90/00114.

FIELD OF THE INVENTION

The invention in general relates to an electrodeless low pressure gas discharge lamp and, more particularly, to a discharge lamp in the envelope of which a plasma may be generated by exciting a high frequency electromagnetic field and in which radiation generated by the plasma is emitted through the envelope.

BACKGROUND

European Patent 0 074 690, POSTMA, discloses an electrodeless gas discharge lamp having a vacuum impervious sealed glass envelope filled with metal vapor and a rare gas, the lamp envelope enclosing a rod shaped core of magnetic material in which a high frequency magnetic field may be induced by a source of electric current whereby an electric field may be generated within the envelope of the lamp.

Furthermore, U.S. Pat. No. 4,959,592, ANDERSON & ROBERTS, and its corresponding German Offenlegungsschrift DE-OS 39 18 839 describe a high intensity electrodeless discharge lamp with an envelope located within the cavity of an excitation coil and with a discharge plasma driven by the excitation coil, high voltage pulses being coupled between a pair of starting electrodes positioned outside of the envelope for inducing the material within the lamp envelope to create a spark channel in which the plasma may be formed in response to the field provided by the excitation coil.

In electrodeless high pressure gas discharge lamps the stability or continuity of the discharge, and the spectrum consisting solely of lines or continuum of superimposed lines may pose problems even though their radiant density and radiant flux may attain relatively high values. On the other hand, electrodeless low pressure gas discharge lamps are of sufficient stability, yet their radiant density and radiant flux are of relatively low value.

Moreover, German Offenlegungsschrift DE-OS 39 08 553, THOMAS et al., discloses a gas discharge lamp filled with deuterium or hydrogen and having a housing positioned within the lamp envelope, which in the discharge path between cathode and anode is provided with an aperture member made of a material of a high melting point, the arc discharge generated between the electrodes being constricted by means of the aperture opening.

THE INVENTION

It is an object of the invention by constricting plasma discharge to provide increased radiant density in low pressure discharge lamps utilizing high frequency excitation, and to accomplish this with as simple a structure as possible.

Furthermore, when using the lamp for absorption measurements relatively simple balancing between the measured radiation and a reference radiation is to be made possible, and, in addition, an overlapping of different spectra from different lamps emitting along a common optical axis is to be made possible.

In the accomplishment of these and other objects the invention provides for arranging in the area of the plasma an aperture member made of a high temperature constant material which is provided with an opening or channel for constricting the area of the plasma, the aperture member having an optical axis extending through the channel, radiation emitting along the axis.

In a preferred embodiment, the aperture member may be made of boron nitride; it is also possible, however, to manufacture the aperture member from quartz glass or from a high temperature constant ceramic such as aluminum oxide, thorium oxide, beryllium oxide, as well as aluminum nitride. Surprisingly, aperture members may also be made from high temperature constant metal such as, for instance, molybdenum.

In a further preferred embodiment, the aperture member may consist of a constricted portion of a lamp envelope made of quartz glass which on both sides of the constriction may be conically flared.

An important advantage of the invention may be seen in the fact that aside from a high stability discharge, an intensification of the radiant density or radiant flux may also be attained.

In a preferred embodiment, the aperture member may be embraced at least in part by a current conducting cylindrical or annular coil, the electrical connections of the coil being connected to the output of a high frequency generator.

Such an embodiment may be particularly advantageous, for an aperture member with an uninterrupted channel therein forms an optical axis so that radiation may emit or radiate from both ends of the aperture member. One radiating side may be directed toward a sensor for controlling or regulating the discharge process, so that a controlled discharge is made possible. In this connection, by completely or partially mirror-coating the lamp envelope with the exception of the discharge openings, an increase in the intensity of the emitted radiation may be attained; moreover, an increase in the intensity of the discharged radiation may also be attained by partially mirror-coating the front face of the envelope directed toward the sensor.

It is possible, moreover, to provide the lamp with first and second discharge chambers for generating a plasma by exciting a high frequency electromagnetic field, each discharge chamber being provided with an aperture member having an opening and an optical axis extending through the opening, the optical axes of both discharge chambers extending along a common straight line with the spectra of both discharge chambers being thus overlapped in a single beam.

It is of particular advantage to provide an aperture member having a channel, from which radiation may be emitted in opposite directions.

In another advantageous embodiment, the aperture body may on opposite sides of its optical axis be embraced by one capacitor plate each, at least one of the capacitor plates being provided with an discharge opening along the optical axis, each of the capacitor plates being electrically connected to an output of a high frequency generator.

Advantageously, the aperture member may be positioned within an electromagnetic resonator which for its excitation may be provided with an antenna electrically connected to the output of a high frequency generator.

In another advantageous embodiment, the aperture member may be provided with a bore along the optical axis, open at one end.

In yet another advantageous embodiment of the invention, the aperture member may be provided with an uninterrupted or continuous channel along the optical axis.

Advantageously, the aperture member may comprise a lamp envelope constricted in the area of the plasma with the wall of the envelope forming a continuous bore in this area.

It is of especial advantage to provide a channel which is conically flared at both ends.

Yet another advantage resides in a lamp comprising first and second discharge chambers for generating plasma by exciting a high frequency electromagnetic field, each discharge chamber being provided with an aperture member having an optical axis extending through a channel, the optical axes extending along a common straight line.

Advantageously, the aperture member may be made from a quartz glass or of metal oxide ceramic material.

In yet another advantageous embodiment, the aperture member may be made from a metal nitride.

In accordance with the invention, yet another aperture member may be made from molybdenum.

In another advantageous embodiment, of the invention the aperture member may be made from diamond or graphite.

In accordance with the invention, the lamp may advantageously be filled with hydrogen.

In yet another advantageous embodiment, the lamp may be filled with a rare gas.

DRAWINGS

FIG. 1 is a schematic representation in longitudinal section of an electrodeless discharge lamp together with a high frequency generator, FIG. 2 is a perspective rendition, partially in section, of the same lamp, FIGS. 3*a*, 3*b* and 3*c* depict different embodiments of the aperture member in cross section, FIG. 4 is a diagram depicting in angular degrees the radiant flux distribution over the discharge range, FIG. 5 schematically depicts a discharge lamp with radiation discharged in opposite directions, a portion of the radiation being directed to a radiation sensor for measuring the intensity of the actual radiation for the purpose of controlling the high frequency generator, and FIG. 6 depicts an arrangement including two discharge chambers the optical axes of which are disposed on a common axis.

DETAILED DESCRIPTION OF THE PREFERRED EMBODIMENTS

Figure 1:
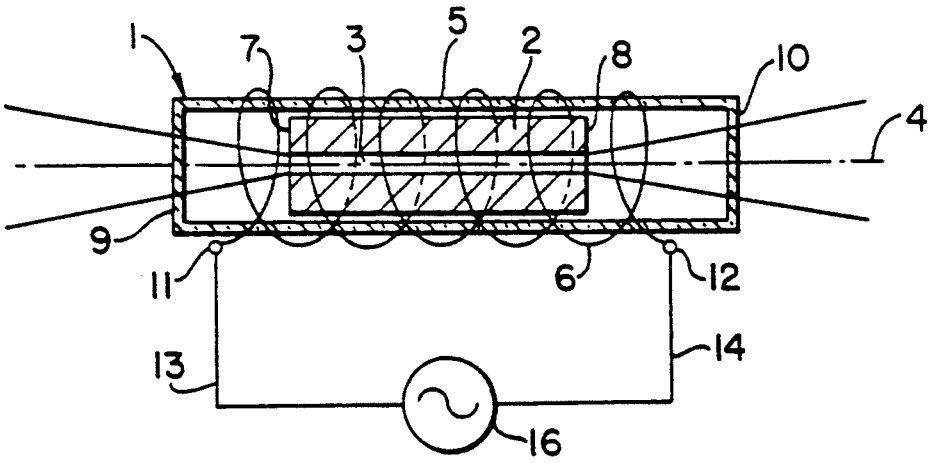

As shown in FIG. 1, a lamp may be provided with a cylindrical envelope 1 made of quartz glass which in the central area of its internal chamber is provided with an aperture member 2, also of cylindrical shape, and which may be provided with a continuous bore or channel 3 extending between its end faces along the axis of the cylinder. In the radial direction, the aperture member may extend to the inner surface of the lamp envelope 1; the optical axis of the radiation emitting from the channel 3 which corresponds to the axis of the cylinder is identified by reference numeral 4. In the area of its cylindrical outer surface 5, the envelope 1 may be surrounded by a similarly cylindrically shaped excitation coil 6 having a copper conductor coated with gold. Two connectors 11, 12 of the excitation coil 6 may be coupled to a high frequency generator 16 by lines 13, 14, the high frequency generator being of the kind generating an alternating voltage of about 10 to about 800 megahertz. The lamp may be filled with deuterium at a cold pressure of 15 millibar. The channel 3 provided in the aperture member 2 may have a length of about 0.1 to about 90 mm and may have a diameter of about 0.1 to about 6 mm. The outer diameter of the envelope 1 may be between about 7 and about 20 mm, and its length may be between about 30 and about 100 mm. Thus, the 6 mm channel diameter is substantially smaller than the 20 mm envelope diameter. To attain convergence of the emitted radiation, the geometry of the aperture member may be formed by a conically shaped hollow member, for instance of frustro-conical configuration. Several embodiments of discharge openings will be described in connection with FIGS. 3*a* to 3*c*.

In its operative condition, the high frequency generator may generate a high frequency current which flows through the excitation coil 6 between its connectors 11, 12, and which generates a discharge arc plasma along the optical axis 4. The excitation coil 6 may have five to seven convolutions. During operation, the beam may exit through end surface 9 as well as through end surface 10 of the envelope 1, that part of the radiation emitted from surface 9 being directed to a sensor 18.

Figure 2:
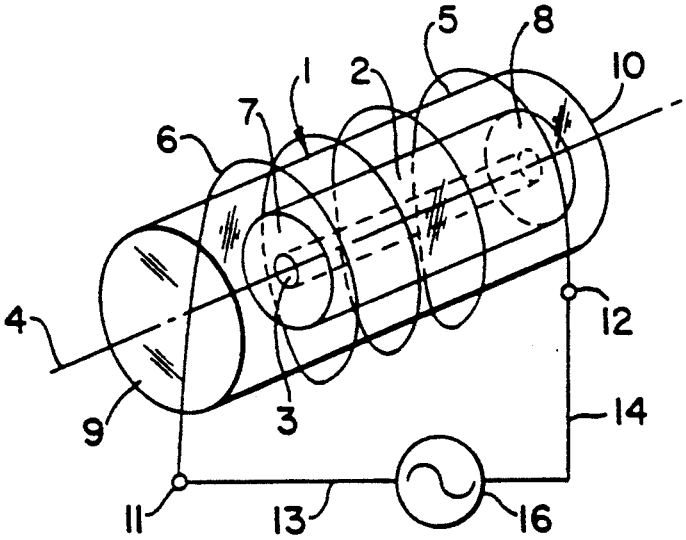

In FIG. 2, the cylindrical lamp envelope is depicted in a perspective view, the aperture member 2 being shown in transparent fashion for the purpose of a clearer display of its channel 3. The arc discharge plasma may extend along the optical axis 4 within the aperture member 2, radiation emitting from both end surfaces 7, 8 of the aperture member 2. Aperture members made of boron nitride, aluminum nitride, beryllium oxide, polycrystalline diamond or graphite have been found to yield the highest radiation densities and radiation flux at aperture lengths of from 2 to 5 mm.

Figure 3A:
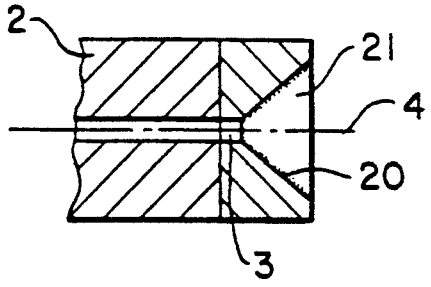

As shown in FIG. 3*a*, aperture member 2 is provided with an emission opening 21 of frustro-conical configuration which flares outwardly. The frustro-conical surface may be provided with a coating 20 reflecting ultraviolet radiation, such as aluminum, for instance.

Figure 3B:
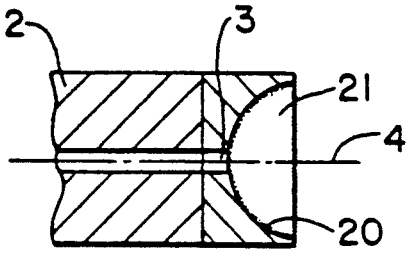

As shown in FIG. 3*b*, the outwardly flaring exit opening 21 of the aperture body 2 is of parabolic cross-section. In this embodiment, it is also possible to provide a radiation reflective coating 20 on the surface of the parabola.

Figure 3C:
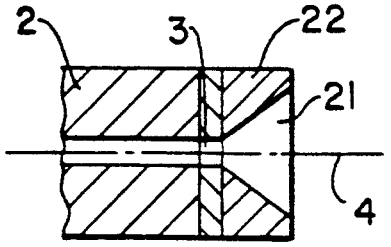

As shown in FIG. 3*c*, a frustro-conical cap 22 reflecting ultraviolet radiation may be affixed near an end face 8 of the aperture member 2, the cap being made from a material having a low melting point, such as aluminum, for instance.

Figure 4:
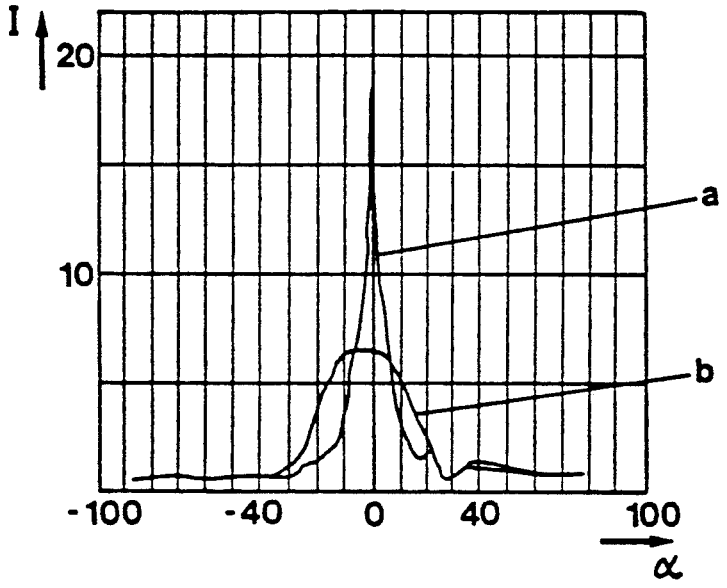

As shown in FIG. 4, the high frequency excited deuterium lamp may emit its radiation over an angular range (field angle) alpha which is more directed than is the case with a conventional deuterium lamp provided with electrodes, the high frequency excited deuterium lamp displaying a radiation intensity distribution I in accordance with curve (a), whereas the conventional radiation intensity distribution of deuterium lamps is depicted by curve (b).

In accordance with curve (a), the width at half maximum intensity attained is between about 5° to about 8° C., while in accordance with curve (b), the width at half maximum intensity is about 36°.

Figure 5:
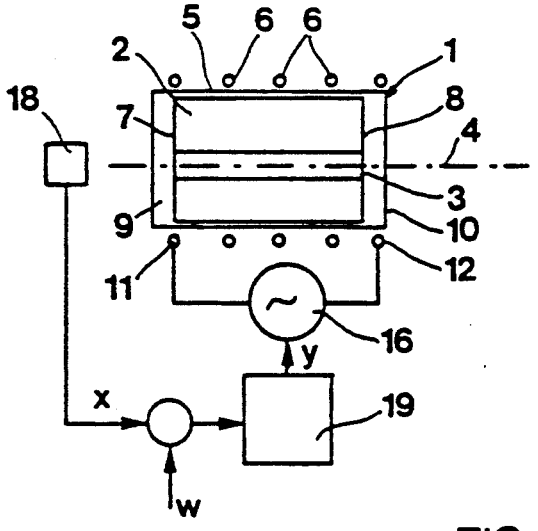

As shown in FIG. 5, during operation the beam may exit from the end face 9 as well as from end face 10 of the lamp envelope 1, the part of the radiation exiting from the end face 9 being directed to a sensor 18. The sensor 18 may be connected to the high frequency generator 16 by way of a control unit 19. At the input of the control unit 19 a signal X representative of the actual value measured by the sensor 18 may be compared with a predetermined reference signal W, and in case of a deviation or difference an adjustment signal Y may be fed from the output of the control unit 19 to the high frequency generator. The adjustment signal Y may cause the high frequency to be modulated, or it may vary the keying ratio of a pulse train frequency, so that the deviation may be adjusted.

In this connection, it may be possible to reduce the radiation directed to the sensor by half-mirroring ("half-silvering") the end face 9 directed toward the sensor and to amplify the radiation emitted from the end face 10.

By arranging the geometry of the discharge lamp in accordance with the invention in a manner being open at both ends, a lamp may be made with two differently filled discharge chambers each forming in itself an integral radiation source, a second radiation source emitting in a different spectrum being present on the same optical axis as a first radiation source; thus, without exchanging lamps, a useful spectral range of increased width may be obtainable. Such an arrangement has been schematically shown in FIG. 6.

Figure 6:
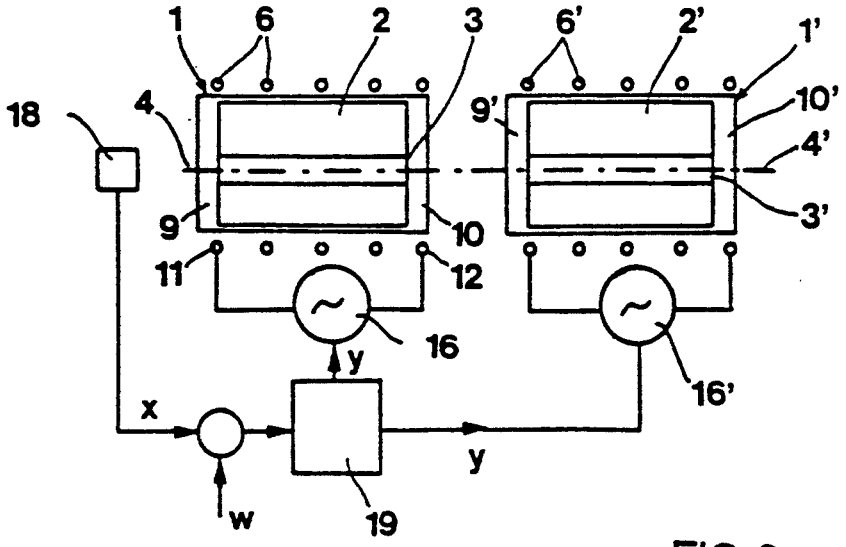

As shown in FIG. 6, radiation may be generated within the envelope 1 which is emitted along the optical axis 4 through the end face 10 of the envelope 1 and which may enter the envelope 1' through its end face 9', the envelope 1' being filled differently from the envelope 1. Radiation generated within the envelope 1' may be emitted along the optical axis 4 through the end face 10' of the envelope 1'. The rays emitted in opposite directions from the end faces 9' and 9 may be directed along the optical axis 4 to a sensor 18 sensitive to a predetermined spectrum and connected to a control unit 19, the adjustment signal y of which may be fed to high frequency generators 16 and 16', or to one high frequency generator common to both lamps. Such an arrangement may be particularly useful for spectral photometers or high pressure liquid chromatography (HPLC).

Various changes and modifications are possible within the scope of the inventive concept, and features of one embodiment may be combined with features of another embodiment.

We claim:

1. An electrodeless low-pressure discharge lamp, comprising a lamp envelope (1) having a first end portion (9) and a second end portion (10);

a generally cylindrical element (2) inside said envelope (1), formed with an aperture defining a linear channel (3) from near said first end portion (9) of said envelope to near said second end (10) portion thereof;

a gas fill sealed in said envelope and extending through said channel (3), and adapted for ionization to form a plasma;

a cylindrical excitation coil (6) surrounding said envelope (1) and connected to a generator (16) for generating a high-frequency electromagnetic field, said gas fill forming a plasma in response to application of said electromagnetic field;

wherein said aperture has a substantially smaller diameter than portions (9, 10) of said envelope beyond axial ends of said cylindrical element (2), thereby confining any arc discharge occurring in said plasma to said smaller diameter, and causing radiation from said arc discharge to be preferentially emitted along an optical axis (4) coinciding with said linear channel (3); and wherein said cylindrical element (2) is made from a high-temperature-constant material.

2. The lamp of claim 1, wherein said cylindrical element (2) is provided with said channel for emitting said radiation in opposite directions.

3. The lamp of claim 1, wherein at least one end of the channel is conically flared.

4. The lamp of claim 1, wherein said cylindrical element (2) is made from quartz glass.

5. The lamp of claim 1, wherein said cylindrical element (2) is made from a metal oxide ceramic.

6. The lamp of claim 1, wherein said cylindrical element (2) is made from a metal nitride.

7. The lamp of claim 1, wherein said cylindrical element (2) is made from molybdenum.

8. The lamp of claim 1, wherein said cylindrical element (2) is made from diamond.

9. The lamp of claim 1, wherein said cylindrical element (2) is made from graphite.

10. The lamp of claim 1, wherein said envelope filling is hydrogen.

11. The lamp of claim 1, wherein said envelope filling is a noble gas.

12. The lamp of claim 10, wherein said hydrogen consists essentially of deuterium.

13. An electrodeless low-pressure discharge lamp comprising first and second discharge chambers (1, 1'), each of said first and second discharge chambers comprising a lamp envelope (1, 1') having a first end portion (9, 9') and a second end portion (10, 10');

a generally cylindrical element (2) inside said envelope (1), formed with an aperture defining a linear channel (3, 3') from near said first end portion (9) of said envelope to near said second end portion (10) thereof;

a gas fill sealed in said envelope and extending through said channel (3), and adapted for ionization to form a plasma;

a cylindrical excitation coil (6, 6') surrounding said envelope (1, 1') and connected to a generator (16, 16') for generating a high-frequency electromagnetic field, said gas fill forming a plasma in response to application of said electromagnetic field;

each aperture has a substantially smaller diameter than portions (9, 10) of said envelope beyond axial ends of said cylindrical element (2), thereby confining any arc discharge occurring in said plasma to said smaller diameter, and causing radiation from said arc discharge to be preferentially emitted along an optical axis (4) coinciding with said linear channel (3);

and wherein said channels in said cylindrical elements define respective optical axes (4, 4') extending along a common straight line.

* * * * *